United States Patent [19]

Tillotson

[11] 4,271,688

[45] Jun. 9, 1981

[54] APPARATUS FOR TREATING PLAITED YARNS

[75] Inventor: John G. Tillotson, Dalton, Ga.

[73] Assignee: Tillotson Corporation, Everett, Mass.

[21] Appl. No.: 17,023

[22] Filed: Mar. 2, 1979

Related U.S. Application Data

[60] Continuation of Ser. No. 818,860, Jul. 25, 1975, abandoned, which is a continuation of Ser. No. 601,393, Aug. 1, 1975, abandoned, which is a continuation-in-part of Ser. No. 570,765, Apr. 23, 1975, Pat. No. 3,981,163, which is a division of Ser. No. 432,449, Jan. 11, 1974, Pat. No. 3,898,035.

[51] Int. Cl.[3] ..... D06B 3/06; D06B 21/00

[52] U.S. Cl. ..... 68/5 D

[58] Field of Search ..... 68/5 D, 5 E, 19, 19.1, 68/20, 158, 177, 203, 205 R; 8/151.2; 34/152, 155, 162; 226/113, 118; 28/281

[56] References Cited

U.S. PATENT DOCUMENTS

| | | | |
|---|---|---|---|
| 2,395,305 | 2/1946 | Vincent et al. | 226/118 X |
| 3,242,702 | 3/1966 | Fleissner | 68/5 E |
| 3,762,187 | 10/1973 | Fleissner et al. | 68/19.1 X |

*Primary Examiner*—Philip R. Coe

*Attorney, Agent, or Firm*—Kenway & Jenney

[57] ABSTRACT

Apparatus for treating yarn ends while plaited in unstressed condition on a conveyor belt. In different portions of a machine the treatment consists in fixing dyestuffs printed upon the yarns and drying the yarns after fixing and subsequent washing. A pair of rolls form a nip through which the conveyor belt and the plaits thereon pass upon leaving each of the treatment means. Yarn pulling means pull the yarns from the nip and off the belt, applying tension against the reaction of the nip without applying stress to the plaits advancing toward it.

4 Claims, 13 Drawing Figures

FIG. 12
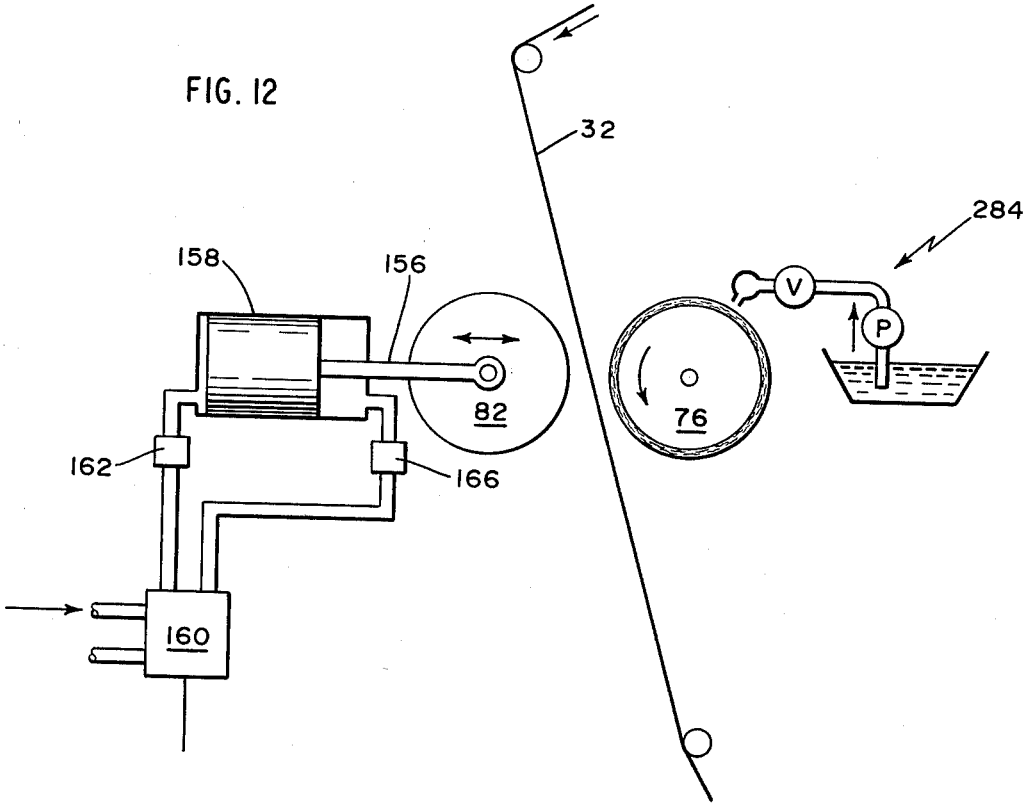
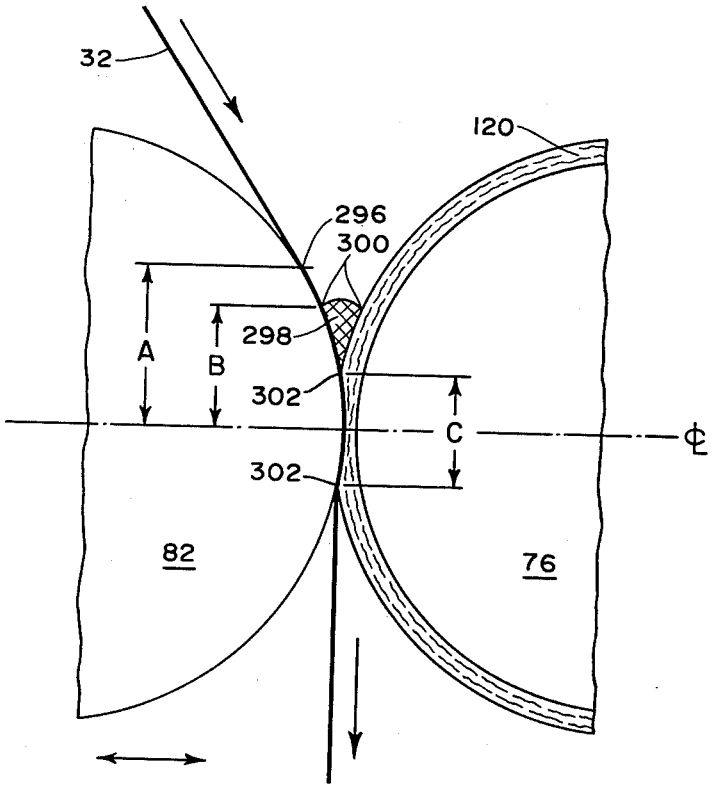
FIG. 13

APPARATUS FOR TREATING PLAITED YARNS

This application is a continuation of Ser. No. 818,860 filed July 25, 1975, now abandoned, which was a continuation of Ser. No. 601,393 filed Aug. 1, 1975, now abandoned, which was a continuation-in-part of Ser. No. 570,765 filed Apr. 23, 1975, now U.S. Pat. No. 3,981,163, which was a division of Ser. No. 432,449 filed Jan. 11, 1974, now U.S. Pat. No. 3,898,035.

BACKGROUND OF THE INVENTION

The field of the invention comprises generally producing pile textiles including carpet, upholstery, and apparel fabrics, in which the pile loops or cut pile yarns of different colors are distributed spatially either in a predetermined pattern or in a random manner.

The prior art teaches the technique of coloring pile forming yarns by printing a pattern of the same or differently colored segments upon a sheet of yarns, followed by the formation of pile in a backing sheet usually by tufting the yarns and to a lesser extent by a form of knitting. The yarns pass through a printing station having means to print the same or different colored dye liquors upon segments of the yarn which are of predetermined sequence of length, the pattern repeating itself at well-spaced intervals to produce the desired pattern or random effect in the finished material. The dyed yarns are wound up on storage means such as cones or beams at some stage prior to the formation of the pile. In subsequent steps, the yarn storage means are shuffled to separate adjacently printed yarns and loaded into a creel or beam associated with a standard multi-needle tufting machine or some other suitable pile-forming machine.

The earlier methods disclose certain difficulties (and at this point reference is made to U.S. Pat. No. 3,447,215 dated June 3, 1963, and U.S. Pat. No. 3,621,780 dated Nov. 23, 1971, John G. Tillotson being the inventor of both) in that regardless of whether a random pattern as set forth in said patents is to be accomplished, or a final ordered pattern is to be accomplished in the final carpet or fabric, difficulty has been experienced in maintaining uniformity in the dyeing of the individual yarns that form the web or sheet of such yarns.

The dyeing of yarns, that is, the receptivity and effect of dyes on yarns, is governed to a great extent by the past history of the yarn itself. The more uniform the past history of the yarns forming a sheet of yarns prior to printing thereof, the more uniform said yarns will be colored prior to entering a tufting machine, for example. It has been found that yarns differ somewhat in their prior history, and therefore, the color of the yarns in a sheet thereof is not as uniform as can be desired.

Particularly is this is true if a crimp or additional configuration or "memories" are established in the yarns prior to the dyeing operation. Also, the stresses in a yarn have an effect on the molecular orientation or disorientation within the fiber itself, and the orientation of the fibers in a yarn end. As a result, it has been found in practice that it is not an easy matter to obtain a desired random pattern or a desired ordered pattern in the final tufted or knitted material.

SUMMARY OF THE INVENTION

Accordingly, the broad purpose of this invention is to provide apparatus for producing a more regular control of the treatment and handling of the yarns during fixation of the dye-stuff thereon, and subsequent withdrawal of the yarns from the dye-fixation apparatus without entanglement.

There are several other objects and provisions of the invention, one of which is the provision of first means for laying the printed yarns on a conveyor belt at one end thereof in plaits and the provision of later means for pulling the yarns off the other end of the conveyor belt in such manner that the yarns are moved from their plait condition into a straight condition under tension; a second object being the provision of nip means at said other end of the belt, and means for pulling the yarns from the conveyor belt under tension immediately after the plaits have passed between said nip means. A third object of the invention is the production of stress-relieved and/or heat-set yarns on a continuous basis.

The invention accordingly comprises the elements and combinations of elements, steps and sequence of steps, features of construction of the apparatus, steps and sequence of steps and features of operation of the apparatus and methods, manipulation of the apparatus and arrangements of parts thereof, all of which will be exemplified in the structures of both the apparatus and in the methods hereinafter described, and the scope of the application of which will be indicated in the appended claims.

In the accompanying drawings, which illustrate the apparatus of the invention and the arrangement of the apparatus, each element thereof in respect to the preceding and subsequent other elements of the apparatus is shown.

FIG. 12 is a schematic illustration of a portion of a second embodiment of the invention, in which the print and pressure rollers are arranged with their axes lying in a common horizontal plane, the pressure roller being movable toward and away from the print roller in said plane.

FIG. 13 is a schematic illustration showing fragmentary portions (enlarged with respect to FIG. 12) of the print and pressure rollers of FIG. 12, and illustrating certain distances.

In the following description, the order of description will be as follows:

I General Description of the Apparatus and the Method Steps
II Yarn Testing Apparatus
III Printing Apparatus
IV Dye Setting Apparatus
V Washing Apparatus
VI Drying and/or Heat Setting Apparatus
VII Yarn Lateral Displacement Apparatus
VIII Yarn Accumulator Apparatus
IX Yarn Longitudinal Alignment and/or Dealignment Apparatus
X Carpet Inspection Apparatus

I GENERAL DESCRIPTION OF THE APPARATUS AND METHOD STEPS

In the general description, each of the method steps will be described in general terms, with the description of the apparatus used to accomplish the particular method step outlined briefly. Thereafter, each of the apparatuses which are part of the general invention will be described. Throughout the desription, in some cases an operation being performed will be described in respect to a single yarn for the sake of clarity. However, it is to be understood that the apparatus and method are primarily for the processing of a sheet or web of yarn ends.

Throughout the description of the application, details which are conventional or which may be supplied by a mechanic without the exercise of an inventive ability, may either be described where such may be helpful in describing the invention, or may be omitted since they can be supplied by art.

Figure 1:
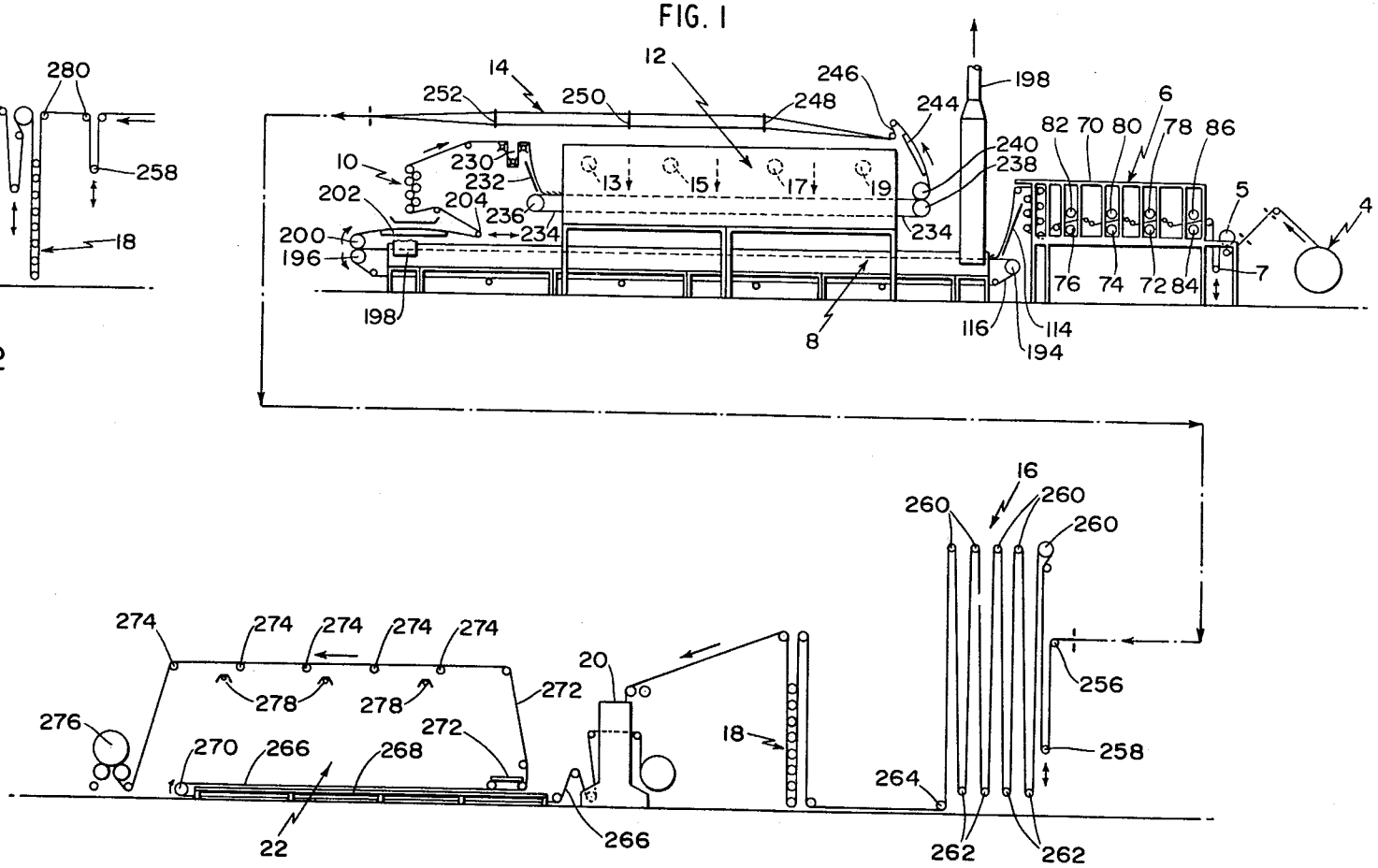
FIG. 1 shows a sequentially ordered array of the individual apparatus units used in one embodiment of the invention, the drawing also illustrating the yarn being processed being fed directly to a tufting machine.

Referring first to FIG. 1, the sequence of production steps, which may be made alone and singly or in combination and continuously, and the improvements embodied in each step are as follows:

Step 1: In order to reduce down time and increase productivity in succeeding steps and thus effect considerable savings, each yarn of a web thereof is first stressed in a testing apparatus, shown schematically in FIG. 3, by passing it around a weighted floating or movable roller which momentarily applies sufficient tension to the yarn to break it if a place occurs in the yarn which does not have a desired tensile strength. When an end of yarn breaks, the testing device is automatically stopped by control means such as a drop wire mechanism. A yarn which does not break then passes around a second floating roller of lower weight in order to reduce the yarn tension to a desirable level for succeeding steps.

Step 2: From the testing station, the yarn ends may be fed directly to a printing apparatus indicated generally by numeral 6 or may preferably be taken up on one or more warp beams indicated generally by numeral 4, before succeeding steps. If taken up on warp beams, then later, yarns from the desired beam 4 are led into the printing apparatus 6. If this practice is followed, the following method is used to reduce beam changing time. Each beam station feeding into the printing apparatus accommodates two beams positioned with their axes parallel. Yarn from one of the beams of each pair is first used, and when the particular beam is empty, the yarn from the second beam is immediately tied in. The empty beam is then removed, and a filled spare beam is put in its place. This alternating use of the beam eliminates most of the down time caused by changing beams when beams run out of yarn. The beams are also arranged so that as many as are in use are simultaneously accessible for tieing or splicing yarn during beam changes.

Step 3: Next the yarn is moved from the beam let-off and through suitable guides by means of a driven infeed drum 5 of sufficient diameter and friction to deliver yarns at a constant and equal rate of travel to a floating or dancer roller 7. This roller is of appropriate weight for delivering yarn at consistent tension desired to the printing apparatus 6. This consistent tension is necessary for consistent dye pick up. The floating roll also actuates switches which start and stop the infeed drum.

Step 4: A suitable dye liquor or low viscosity paste is then applied by apparatus 6 to the yarn. This is done in a series of roller stations within the apparatus by pressing the yarn by means of a movable top roller against a bottom felt covered roller which is partially immersed in a trough containing the dye material, and which is driven at approximately the same surface speed as the yarn. While only one set of top and bottom rollers may be used, the use of a plurality of sets is preferred (as shown) for greater facility and speed of coloring the yarn in preselected patterns and colors. The dye material level in the trough is maintained by a liquid level control system. The amount of dye material in the cover material of the bottom roller when it contacts the yarn, is determined by a weighted doctor roller that rides against the bottom roller. The duration of contact between the yarn and the covered roller is controlled by a mechanical programmer that actuates switches which in turn actuate air valves. The latter supply air to air cylinders at the ends of the pistons on which are mounted the bearings for the top rollers. Actuation of the air valves for each set of rollers causes the top roller to move downwardly and press all of the yarn ends passing through the particular set of print rollers down against the dye-laden covered bottom roller for a predetermined length of time. A plane containing the axes of the bottom and top rollers of a given set is related to the direction of the path of the sheet between the rollers so that the sheet makes an angle with respect to the plane of 80°–95°. As a result, the puddle of dye paste formed behind the nip of the rollers while the rollers are in contact and printing the yarn ends will fall away from the yarn ends when the top roller is lifted by the force of gravity, as well as the capillary action of the bottom roller cover. By this means, there is eliminated or at least greatly minimized, any tendency for the paste puddle to follow the yarn beyond the roll nip to cause smearing on the yarn and waste of dye paste.

The yarn path is controlled by yarn guides (not shown) on either side of the print rollers. The length of stroke of the air cylinder pistons, the overall length of the air cylinders and the air pressure in both ends of the cylinder at all times are controlled to insure clean sharp prints.

The mechanical controller is best described as a plurality of discs having holes in their perimeters in which may be inserted rubber flat-topped pegs. The holes are so spaced that the tops touch and thus form a switch operating cam surface of a pre-set length. The length is adjusted by changing the number of adjacent pegs.

A further feature is the use of an electric brake/clutch to disengage the programmer and hold its position while yarn is jogged through the printer. This is done to correct for wet yarn length growth which occurs during printing, if the passage of yarn through the printer should be stopped for a period of time. If not corrected, the yarn growth results in the prints made on start-up to be out of sequence and causes errors in the final fabric.

It has been determined that dye paste printed on yarn tends to migrate toward the longitudinal axis of the yarn. This is the result of greater capillary force along this central axis which is caused by more fiber compactness than the fiber compactness at the surface of the yarn. The greater amount of paste in the center of the yarn causes it to be a darker color than the surface of the yarn. Unacceptable non-uniformity of color depth results from excessive variation in the ratio of surface-center paste present when dye fixation occurs. This variation is made acceptable by reducing the surface tension of the paste to the point that sufficiently offsets the higher capillary forces present in the center of the yarn, or by drying the paste before fixation which causes the paste to migrate back to the surface.

A plurality of finned rollers pull the yarn through the printer. Each of these rollers has four fins attached longitudinally to the roller along the length thereof and extending radially outwardly. The fins are necessary for reducing surface contact of the wet printed yarn with the roller surface. If a plain roller is used, an excessive amount of dye paste is transferred to the roller and redeposited on yarn. This causes an unwanted second printing. The fins also reduce the amount of cohesion between the wet yarn and the roller permitting easier release from the latter. Also, if a yarn end does not release from the roller, it will wrap around the latter and cause a shut down. After the yarn has passed through the finned rollers, it falls by gravity onto a chute that leads to a conveyor belt which then moves the yarn to the apparatus for die fixation. If the yarn is allowed to fall freely on the conveyor belt, adjacent yarn ends will twist around each other and cause tangling which will prevent later separation of the yarns. By using the chute, movement of the yarn ends is restrained so that unwanted twisting is prevented and the yarn is deposited without stress and without entanglement in plaits on the conveyor belt, automatically in such manner that the plaits of adjacent yarns tend to lie next to each other or on top of each other. When the yarns are later pulled from the belt, this minimizes any tendency of the yarn ends to tangle.

The web or sheet width of the yarns leading into and out of the printer 6 is controlled by guide bars or reeds which have as many holes as there are yarns ends to be processed. The spacing between the holes determines the length of the guide bar and the width of the web. For most efficient operation, the web is made narrow during printing so as to minimize side to side printing variations, and is made wide for dye fixation, washing and drying so as to increase surface exposure of the yarn to these subsequent operations.

Step 5: The yarn is then passed into the dye setting or fixation chamber indicated generally by numeral 8. A horizontal conveyer belt 116 which is of open mesh construction to permit air or steam to pass easily through it, has its upper reach enclosed by the steam chamber 8. This chamber has means for admitting live steam beneath the upper reach of the belt and means for heating the roof of the chamber, which is over the upper reach. The heated roof prevents steam condensation and makes possible a temperature in the chamber of 210° to 230° F. An air lock 198 is provided at both ends of the steam chamber. The air locks are fitted with suitable exhaust means which are used to purge air from the steam chamber, carry off excess steam from the chamber, and also cool the yarn before it exits from the steam chamber.

The yarn ends are deposited on the conveyor belt at the inlet end of the steam chamber and pass thru the latter in a relaxed state. Live steam passes upward through the conveyor belt and through the yarns while heat is radiated downward thereon from the chamber roof.

Step 6: The yarn progresses to the exit end of chamber 8, and does not leave the conveyor belt until it has passed through the nip of the exit rollers of the belt. The yarn then passes through a washer indicated generally by numeral 10, and which consists of a plurality of vertical adjacent rollers. The odd-numbered rollers are non-porous, fixed and driven; while the even numbered rollers are covered with a porous material, and are free turning and movable toward or away from the fixed rollers. Water is applied along the entire length of the second roller from the top, and since the rollers are vertical the water cascades downward over all of the rollers.

The yarn from steam chamber 8 enters the wash roller stack at the bottom and follows a serpentine path around the rollers to the top. The cascading water and the squeezing action in the roller nips effectively wash out any unfixed material from the yarn ends. The uppermost nip (since water is supplied below it) extracts water from the yarn ends and prepares them for drying. The quantity of water needed with this method and apparatus is reduced greatly since the water is used several times during its path down the rollers. Also, each covered roller is squeezed at two opposite sides rather than one as is normally the case with a series of two roller wringers. This doubles the number of wringings for any given number of wrapped rollers or halves the number of wrapped rollers needed for any given number of wringings.

A pan is provided under the stack of rollers to collect the spent water. The yarn then passes to another set of finned rollers and to an inclined chute as described in Step 4, and thence onto a conveyor belt leading into drying chamber indicated generally by numeral 12.

Step 7: After leaving the chute in Step 6, the yarn is deposited as plaits on the upper reach of a horizontal open mesh conveyor belt 234 which is enclosed by the hot air chamber. This chamber has means for moving air from under the upper reach of the belt, exhausting part of this air, adding fresh replacement air, heating the air and forcing heated air downwardly from above the top level of the belt, thru the yarn and thru the upper reach of the belt.

The movement of the yarn, while in the relaxed state on the belt through the hot air chamber, and its exposure to hot air therein makes possible fast efficient drying and/or further stress relieving.

Hot air chamber 12 is provided with pairs of nip rollers immediately adjacent the inlet and exit of the chamber, through which pass the belt and the yarn. The entrance pair of nip rollers prevent hot air from blowing out of the chamber and also compact the yarn for more efficient drying.

The exit nip rollers of the hot air chamber serve the same function as described in Step 5, that is, the yarn ends are pulled from the conveyor belt only after passing through the exit roller nip.

The configuration of the hot air chamber is such that after a thermoplastic yarn is dryed, its temperature may be effectively and uniformly raised to stress relieving or setting temperatures for the particular yarn. For this purpose, the introduction of the hot air into the hot air chamber is done by a plurality of blowers 13, 15, 17 and 19. As an example, blowers 13, 15 and 17 will provide air at a temperature below the heat setting temperature of the yarn being processed, and blower 19 will provide air which is of high enough temperature to raise the yarn to the setting temperature. Thus, this raising of the yarn temperature occurs preferably during approximately the last (prior to exit) quarter of the passage of the yarn through the chamber. It is thus possible to stress relieve or heat set a thermoplastic yarn in the hot air chamber either in conjunction with or separately from the drying operation.

Step 8: The yarn then passes from the restraining nip of the exit nip rollers beyond the dryer belt exit and around two or more fixed bars which further restrict movement of the yarn on the belt. Sufficient tension for carrying out Step 8 and the following Step 9 is applied at this point by another weighted floating roller 258. Between the restraining bars and the floating rollers each end of yarn is passed thru a separate guide. The guides are spaced so that all the ends of yarn are restored to approximately the same longitudinal and lateral alignment that they were in when printed.

Step 9: Each end of yarn then passes thru the additional guides of the "shuffler" 14 which are so positioned that each end of yarn (or the ends of a group of yarns) is shifted from the lateral position in relation to all other yarns that the yarns had when leaving the printing apparatus 6, to a new lateral position in relation to all other yarns. The new lateral position will eliminate any side to side color variations which may be present in the printed web of yarn, preferably each yarn is shifted to the maximum mathematical position away from the original printed lateral position. Such a shuffler is shown and described in the aforesaid U.S. Pat. Nos. 3,447,215 and 3,621,780, the teachings of which are incorporated herein by reference.

Step 10: The yarn then passes around the floating roller 258 and then to an outfeed drum similar to that described in Step 2 which is controlled by switches that are operated by the above floating roller. From the outfeed drum, the yarn passes around any desired number of floating rolls comprising an accumulator 16 which is used to accumulate and store yarn during interruptions in any subsequent steps and thereby permitting preceding steps to continue without interruption.

Step 11: Each end of yarn then passes thru a separate movable guide. Each guide can be moved so that the longitudinal relation of each yarn to all other yarns can be changed. Differences in the lengths of the paths of different ends of yarn causes them to be displaced from the longitudinal alignment existing when the yarns were printed; or, if already displaced, by moving the above movable guides the longitudinal printing alignment can be restored. The movable guides can be either the first set of rollers of accumulator 16, or can be the first set of rollers of the de-aligner 18.

II YARN TESTING APPARATUS

Figure 3:
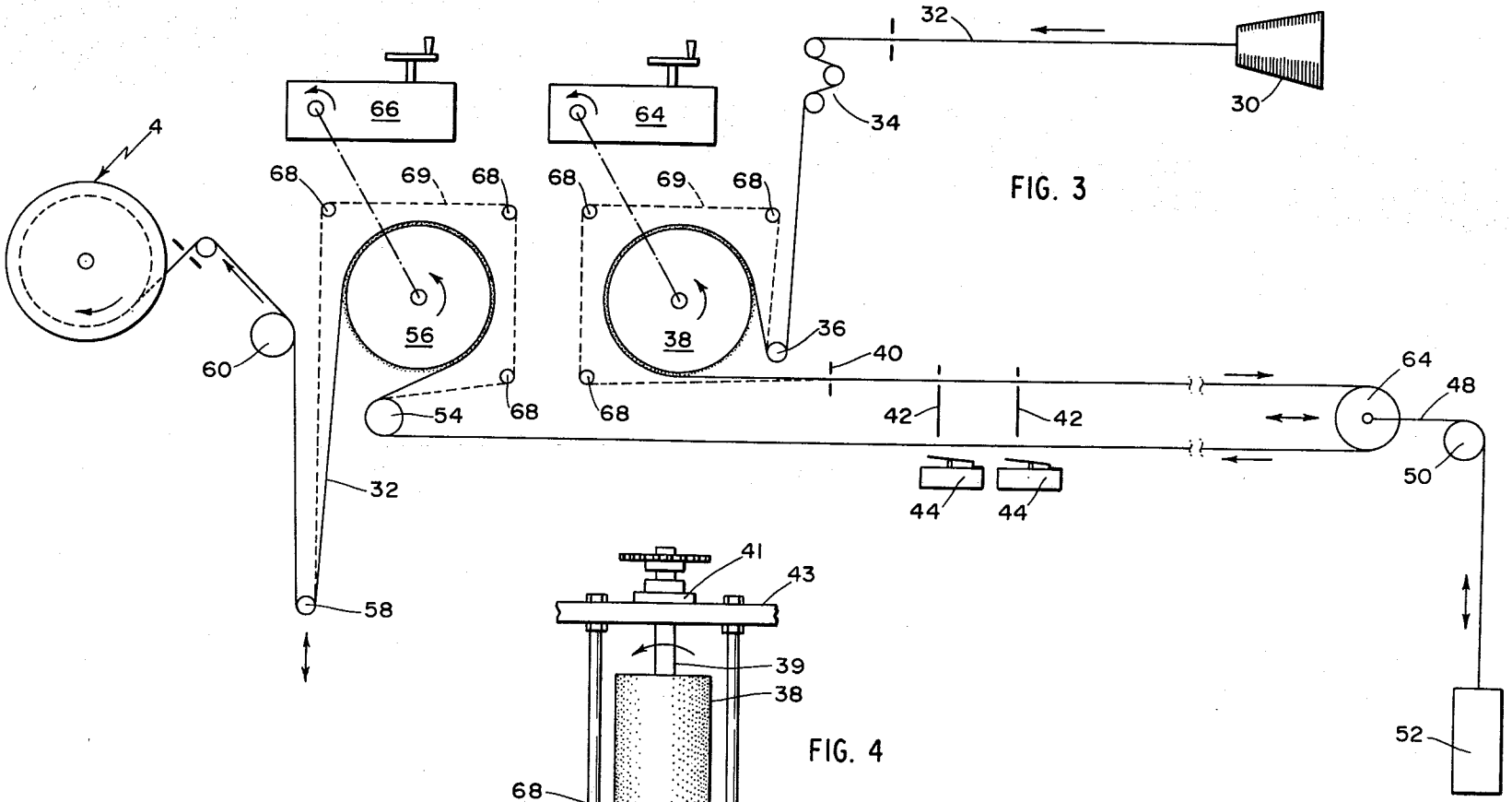
FIG. 3 is a schematic drawing of a yarn testing machine, the yarn from the testing machine to be fed either directly to the dyeing apparatus of FIG. 1 and FIG. 2, or to be stored on a beam which is then fed into the dyeing apparatus of FIGS. 1 and 2.

The yarn inspection device indicated generally by FIG. 3 is a means for taking yarns from a supply package such as cones or beams, and passing them through an apparatus which will test for weakness in the individual yarn ends by applying tension to each yarn end, and thereafter relaxing that tension before the individual ends exit from the inspection device. To that end, a supply package 30 is shown, in this case being a cone of yarn, one for each yarn end. From the cone 30, a yarn 32 passes through suitable tension bars 34 and around the fixed roller or bar 36. The yarn then passes around a drum 38 which comprises a cylinder (preferably hollow) approximately one foot in diameter, the surface of the cylinder being covered with a friction material such as waterproof emery cloth 80–100 grit, the latter being cemented on the drum in any conventional manner. Drum 38 is supported by its shaft 39 in bearings 41 supported in framework 43 of the apparatus. After passing around the greater part of the periphery of drum 38 so that the rotation of the drum will accurately and without slippage draw the yarn through tension bars 34, the yarn thereafter passes (by suitable guide means 40 of conventional nature) through a drop wire or warp thread shut-down device indicated generally by numeral 42. (Each yarn has such a device.) Such devices are conventional, and are used in looms, and consist of, for example, wires or plates having a hole at one end thereof through which the yarn passes. If a yarn breaks, then the particular wire will drop and actuate a suitable stop mechanism for the drum. (Since there will be a plurality of yarns passing around the rolls, there will be a plurality of drop wires.)

After each yarn 32 passes through its respective drop wire or other breakage indicating device, it is passed around a roller 46 which is mounted in suitable bearings at its ends, and is adapted to move horizontally. Attached to the bearing of the roller by suitable means such as a bridle is a wire 48 passing over pulley 50. A weight 52 is suspended from wire 48.

Weight 52 is of such size that a pulling force of two to ten pounds (depending upon the yarn material and yarn size being tested) will be exerted on each yarn end. That is, if there are, for example, 50 yarn ends encircling the horizontally movable tension roller 46, the weight 52 will weigh 100 to 500 pounds, so that each yarn will be pulled with a force of two to ten pounds.

After the yarn 32 encircles the tension roller 46, it proceeds to roller 54, is trained around the latter and then encircles a drum 56 like drum 38. Drum 56 is also mounted on its own shaft in suitable bearings 41 supported by framework 43. Drum 56 is covered, as is roller 38, with a non-slip covering, such as a waterproof 80 to 100 grit emery cloth. After partially encircling the roller 56, yarn end 32 is lead downwardly and supports the relatively lightweight dancer roller 58 which is used as a tension relaxing roller as will be explained below. From roller 58, the yarn end passes upwardly and over roller 60 and thence leftward (as viewed in FIG. 3) through a suitable guide 62, the latter being used to laterally align the yarn ends prior to either winding the yarns on a beam 4, or conveying the yarns directly to the printing device.

Separate drives and speed controls indicated by numerals 64 and 66 are provided for drums 38 and 56 respectively. Each of the drums, therefore, can have its speed adjusted to be at a different rate than the other one. The purpose of having the drum speeds at least initially variable, is to be able to transport yarn by drum 38 in order to apply the weight 52 to roller 46. Also, to adjust for stretch in the yarn.

After the yarn ends have left transport drum 56, then by means of the dancer roller 58, which is a floating roller enabled to move vertically up and down, a tensioning force less than the testing force may be applied to the yarn ends. For example, by means of the floating roller 58, approximately 0.6 to 0.8 pounds tension force may be applied to the yarn end. This is a constant tension applied to all the yarns for the next step in the sequence, which may be either winding on a beam, or feeding directly to the printing apparatus.

It is to be noted that the drive and speed controls 64, 66 can be controlled manually, or can be controlled automatically through the use of certain of indicators associated with each of the weight 52 and the floating roller 58, in order to automatically maintain the proper speeds for testing the yarn end, and for relaxing the yarn end prior to entering the alignment guide 62.

If desired, the testing system will test for matters such as a poorly made splice, improperly tied knots, and physical flaws in the fiber bundle which forms the yarn end. By this unit, an additional advantage is obtained, in that almost immediately after tension is placed upon a yarn end or all of the yarn ends in a sheet extending across the transport drums, the tension is relaxed by means of the grip of transport yarn drum 56 on the yarn end as it traverses the drum, and then passes down and around the relatively lightweight floating or dancer roller 58. In this manner, destruction of crimp configuration in the yarn is avoided.

Figure 4:
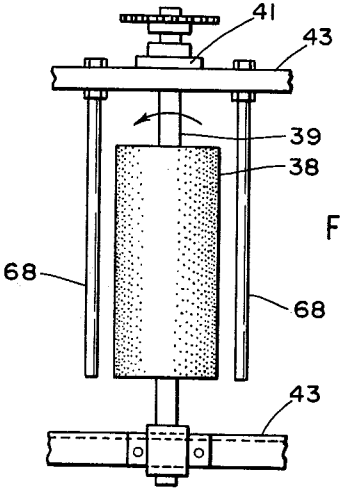
FIG. 4 is a schematic plan view of a portion of the FIG. 3 apparatus.

Referring again to FIGS. 3 and 4, a set of threading guide bars 68 are shown for each of the yarn transport drums 38 and 56. The threading bars constitute elongated stainless steel polished rods having their ends cantilever mounted on the rear plate or framework 41 on which the bearings for the drums are mounted, these bars extending over and under the drums but displaced therefrom and with their axes parallel to the axes of the drums. They are spaced from the drums a matter of a few inches.

The purpose and use of the bars is as follows: In view of the fact that the engagement of the drums 38 and 56 with the yarn must be positive and have no slippage, it has been indicated above that the drums are covered with a non-slip covering such as a waterproof emery cloth having a grit size of 80 to 100. If it is attempted to thread an end of yarn around the drums and position such a loop around the drum at a place along the length thereof, of necessity and almost inevitably the sharp grit of the emery cloth will catch and possibly damage the yarn itself. With the above feature, each yarn end can first be threaded around the threading bars without contacting drum 38. Without removing the yarn from the threading bars of drum 38, the individual yarn end is then trained on the tension roller 46, the roller 54, and then around the threading bar 68 associated with the transport drum 56. Thence, the yarn is trained around the floating dancer roller 58, over the pulley 60, and through the guide 62 to the take up device.

The operator then returns to the transport drum 38, and places his hands between the yarn 32 and the drum at the top two threading bars. By so doing, he will be able to pull the yarn end toward himself and off the end of the threading bars, and then move it backwardly toward the far end of the drum, all without having the yarn come in contact with the rough surface of the drum. Of couse, this will loosen the yarn somewhat, but the tension roller 46 will take up this slack while this is being done. Having positioned the yarn 32 properly in its place on the transport drum 38, the operator then goes to transport drum 56, and repeats the operation on that drum. Again, the floating roller 58 will take up the slack when this is done. The position of the yarn 32 on the bars 68 prior to removal therefrom to be placed on the drum itself is indicated by the dotted lines 69.

III PRINTING APPARATUS

Referring again to FIG. 1, the printing or coloring apparatus is indicated generally by numeral 6, and comprises an angle iron framework 70 adapted by suitable longitudinal and vertical members to support bearings at the end of a plurality of print rollers, as well as other associated apparatus. The print rollers occur in sets of two each, the bottom rollers 72, 74 and 76 of each set being mounted in bearings which are stationary with respect to the frame. The bearings of the top rollers 78, 80 and 82 of each set have their bearings slidably mounted in the framework 70 so that the top rollers may move in an up and down direction with respect to the bottom rollers.

Figure 2:
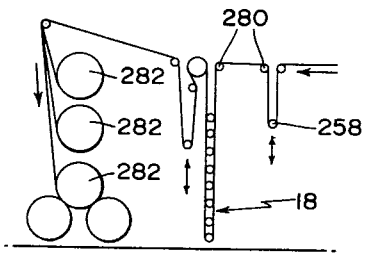
FIG. 2 shows other apparatus which may be used in a second embodiment together with certain parts of the FIG. 1 embodiment, so that the yarn after longitudinal de-alignment is stored on beams rather than being fed directly to a tufting machine.

In FIGS. 1 and 2, an additional bottom roller 84 is shown with its matching top movable roller 86. However, in FIG. 5, which will now be referred to for details of the construction, only three top print rollers are shown, that is, the print rollers 78, 80 and 82, with bottom rollers 72, 74 and 76. The reason for illustrating the additional set of rollers 84, 86 in FIG. 1 is to illustrate that as many sets of rollers may be added to the print dyeing apparatus as needed or desired.

Figure 5:
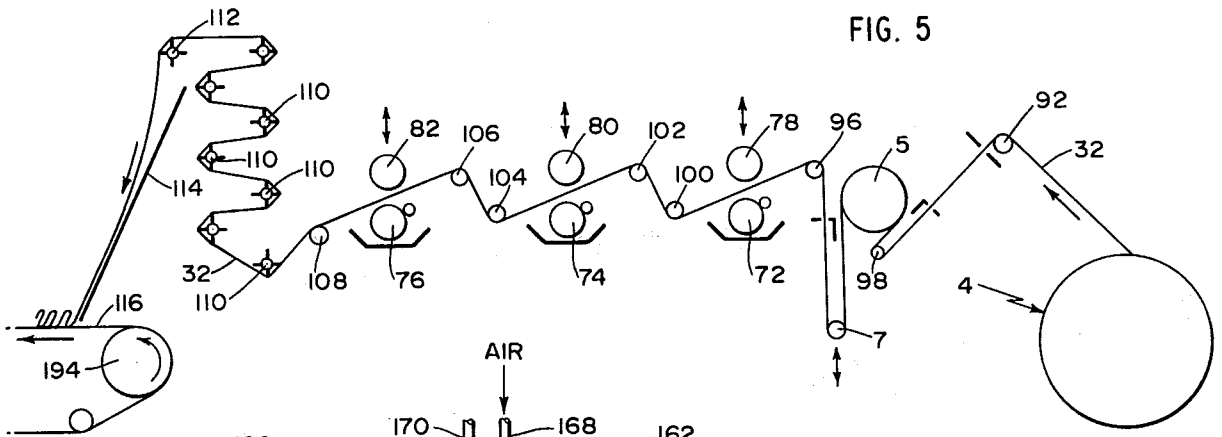
FIG. 5 is a schematic view showing the progress of a single yarn which forms a part of a sheet of such yarns, through a printing apparatus, it being understood that the single yarn is representative of a web or sheet of yarn ends.

Assuming that the material from the testing apparatus has been taken up on a beam 4, FIG. 5 indicates beam 4 as mounted in front of the printing apparatus. From the beam, individual yarn ends 32 are passed through an aligning device or reed 90 in order to set them in a definite aligned parallel relationship as they leave beam 4. They then pass over a roll 92. From roll 92, they pass, through suitable aligning devices, to a non-slip driven transport drum 5 which is covered with a non-slip material such as rubber. From drum 5 the yarns 32 pass downwardly over a floating dancer roller 7 to again establish the proper yarn tension during passage through the printing device, and then up over a stationary roller 96. In order to be sure that the rotation of the yarn transport drum 95 accurately feeds yarn from the beam 4, the yarn encircles approximately 270° of the periphery thereof, and to this end, an additional stationary roller 98 is provided.

After leaving the guide roller 96, the sheet of yarns 32 passes in a slanting manner between the first pair of print rollers 72, 78. The function of this slanting entrance between these rollers (which are shown as separated in a non-printing position), will be described in connection with FIG. 6. From the pair of rollers 72, 78, the yarn sheet or web passes below a guide roller 100 over guide roller 102 and again passes between the space between the print rollers 74, 80 in the same slanting direction as for the first pair of rollers. Again, the yarn web passes underneath a guide roller 104, over a guide roller 106 and passes between the separated print rollers 76, 82 and down over the guide roller 108. From the guide roller 108, the web of yarns passes around a plurality of finned transport rollers 110, the function and construction of which will be described below in greater detail in reference to FIG. 6. After the yarn web passes over the top finned transport roller 112, the yarn is allowed to fall naturally by gravity onto a Teflon-coated stainless steel yarn restraining slide or chute 114 and onto the conveyor belt 116 which leads into the hot box or steamer 8. In so falling, it will be noted that as the yarn ends of the web reach the conveyor belt, they fold gently one over the other to form what will be called hereinafter plaits. At this point, the yarns are in a completely relaxed condition.

As has previously been set forth, one of the advantages of this invention is that prior to the drying mechanism, the yarn is maintained in an untangled condition, and is kept in a controlled tension condition during the printing operation. Uniformity of the final dyed color of the yarn by this sequence of operations is much higher, as well as uniformity of printing being greater, than has been experienced in the prior art systems.

The use of the chute enhances the above: As has been indicated, the yarn after dyeing drops by gravity from the last (exit) finned roller 112 onto the Teflon coated stainless steel chute 114. This chute is at an angle to the vertical of about 20°, and as a result, since the yarn is still wet, the chute restains movement of the yarn and thus minimizes twisting. The chute also maintains under control the lateral alignment of the yarns. The chute therefore prevents the yarn from tangling when it is deposited on the conveyor belt 116, and instead of haphazardly dropping downwardly and thus haphazardly folding on the conveyor belt, each individual yarn end tends to fold gently on top of itself and adjacent yarn ends, so that when the yarn ends are eventually withdrawn from the conveyor belt, little or no entanglement occurs.

Figure 6:
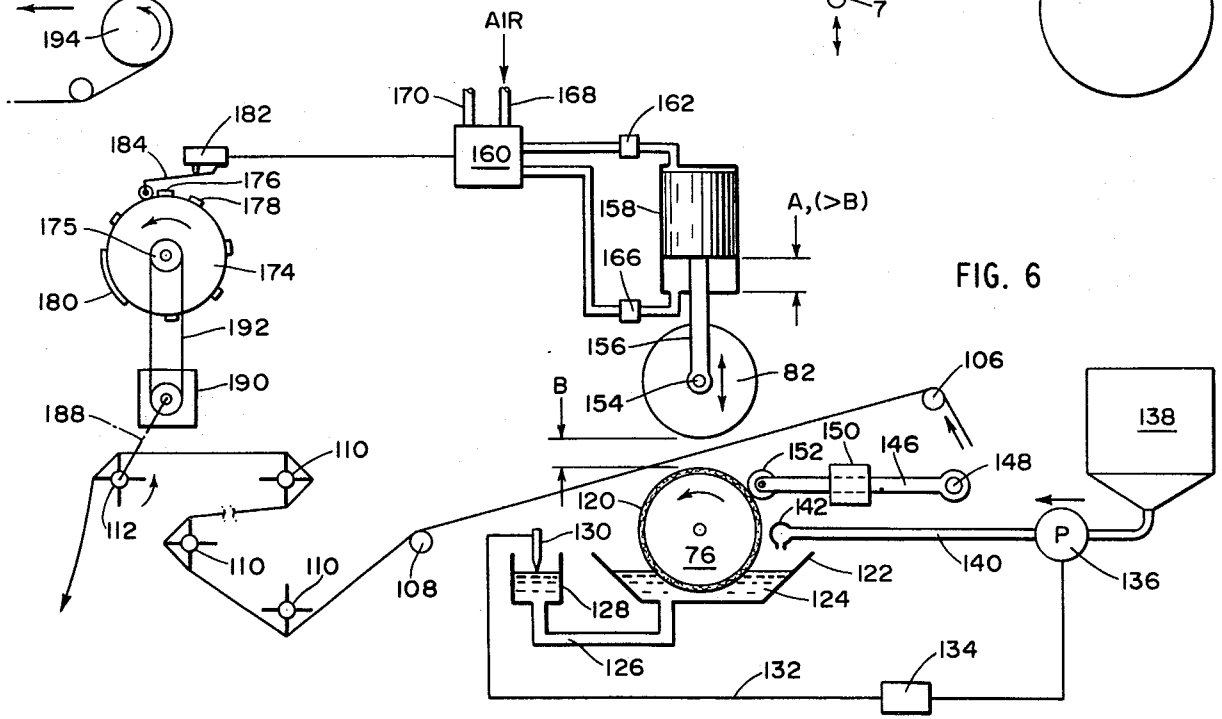
FIG. 6 is a schematic view showing in enlarged detail certain features of the printing apparatus of FIG. 5.

Referring now to FIG. 6 for further details of the printing apparatus, the drawing schematically shows a single pair of print rollers and their associated apparatus. In this example, the last pair of print rollers, that is, the print rollers 76, 82 of FIGS. 1 and 5 will be used. The following description, however, applies to each pair of the print rollers.

As an example, the bottom print roller 76 is shown, and is covered with a non-woven fabric 120 having a needle punched face. The needle punched covering material is generally about 1/32 inch thick, and three turns wrapped around the stationary roll 76, so that the total thickness is about 3/32 inch. Below the stationary roll 76 is a dye pan 122 containing the requisite colored dye 124. The dye pan extends the full length of the bottom roll, and the bottom roll can be, for example, about 4 feet. A small tube 126 connects the dye pan to a dye control unit 128 which has mounted at the top thereof (but insulated therefrom) a dye level probe 130. When the level of the dye in the pan 122 is the proper height with respect to the stationary rolls 76, that same level will be attained in the dye sensing member 128, and the probe 130 is adjusted at that point. The dye probe is connected electrically by suitable connections 132 to dye pump control 134 which in turn is connected to dye pump 136 into which feeds the lower end of a dye supply tank 138. When the level of the dye in pan 122 drops below a predetermined height, the level in the dye control probe member 128 also drops the same amount, and the probe 130 leaves the surface of the dye. This breaks the connection to the dye pump control, which in turn starts the dye pump 136. Dye then flows via the tube 140 to an infeed pipe 142 which lies over the dye pan 122. Dye then flows into the pan until the level thereof, and thus the level of dye in the probe pan 128, rises to the point that contact is again made with the dye probe 130. This will actuate the dye pump control and stop the feed of dye to pan 122.

Since the rolls 76 are immersed in the dye, the covering thereof will pick up dye from the dye in the pan.

Mounted adjacent to the stationary roll 76 is a doctor roll or mechanism, the mounting being shown schematically, and comprising a lever 146 mounted by a pivot at one end 148 and carrying an adjustable slidable weight 150 thereon. The end of the lever adjacent the roll 76 has a rotating roller 152 thereon which presses against the material-wrapped surface of the roll 76. By adjusting the weight, the amount of dye picked up by the material can be made greater or less, in order to adjust the amount of dye deposited on the yarn ends as they pass through the rolls. Upper roll 82 is made of smooth, polished stainless steel.

As indicated earlier, the bearings 154 at each end of the upper print rolls 82 are adjustably mounted so that they may move upwardly, and vertically, and downwardly with respect to the print roll 76. Each of these bearings is attached to the piston rod 156 of an air cylinder 158, an air cylinder being used for each end of a given upper roll. A solenoid air supply control valve 160 is provided, whose control will be described below. Air from the solenoid control valve, when the latter is actuated in one direction, will flow through a check valve 162 and into the top of the air cylinder 158, and piston 156 will begin to move downwardly. Air from the solenoid valve will flow through the check valve 166 when the solenoid valve is operated in the other direction, and will therefore pass into the bottom of the cylinder 158 to move piston 156 upwardly.

The check valves 162 and 166 are of the kind in which air will pass rapidly therethrough and into the respective end of the cylinder, but air will pass therethrough in the opposite direction only slowly. Solenoid valve 160 is provided with a suitable air supply 168, and an exhaust 170 for the air which is forced out of the cylinder by actuation of the piston.

The solenoid valve, and the air cylinder together control the up and down motion of the upper print roller 82. Under the control, without check valves 162, 166, if the air cylinder were designed both in length and operation so that the roller 82 would be moved rapidly down against the lower roll 76, the result would be either to damage the covering of the roll, damage the yarn passing therethrough, or would spatter dye over adjacent portions of yarn on which no dye is desired. Also, since unavoidably the upper roller 82 will pick up dye during the dyeing operation of the section of yarn, and if the upper roller is moved rapidly upwardly by the piston to the point that the piston 164 hits suddenly against the upper end of the air cylinder, again dye on the roll 82 will be shaken off or spattered on yarn where it is not desired. Accordingly, the function of the check valves 162 and 166 is to cushion the downward and upward motions of the piston 164, respectively. The operation is therefore as follows: When air is supplied by the solenoid valve to the cylinder 158 through check valve 162, it flows freely therethrough, and as a result the piston 164 moves very rapidly down toward the bottom end of the cylinder. The distance A between the bottom of the piston 164 and the bottom end of the cylinder is made greater than the distance B between the nearest points of the perimeters of upper roll 82 and bottom roll 76. As the piston 164 moves rapidly at the start of its motion downwardly, the air within the space A begins to compress, because air can flow backwardly through the check valve 166 only slowly. As a result, compression of the air in the space A begins to slow the motion of the piston downwardly as roller 82 approaches roller 76. That is, piston 164 is cushioned by the compressed air, with the result that the roller 82 makes contact with roller 76 gently.

In order to maintain accuracy of printing, it is necessary to withdraw the roll 82 quickly from the roll 76. Again, the function of the check valve 162 permits this. When the solenoid control valve 160 is actuated so as to feed air through the check valve 166 rapidly to move piston 134 upwardly, the roll 82 is moved rapidly and forcefully in an upward direction. As it does, the air which previously had been at the top of the piston can now flow only slowly back through the check valve 162, with the result that while the initial motion of the roll 82 is rapid in an upward direction, yet as it approaches the upper end of its motion, the air within the cylinder becomes compressed and slows this motion so that the piston comes to a gentle stop at its uppermost position.

The operation of the solenoid valve is controlled by a control drum 174, that is, a drum type timer or other sequencing timer. The drum is illustrated schematically in FIG. 6, and is shown and described in greater detail in reference to FIGS. 8 and 9. The drum is equipped with projecting studs 176, 178, and 180. (These studs are numbered only by way of example.) Mounted in connection with the drum is a snap-acting switch 182 having a lever 184 for actuation thereof. When lever 184 is in a downward direction as illustrated, the solenoid valve is operated in one direction and when it is in an upward position (moved thereto by means of studs) the solenoid valve is actuated in the other direction. As the drum rotates clockwise, as illustrated by the arrow, and looking at the switch actuating stud 176 as an example, it is of intermediate length, and upon rotation of the drum the arm 184 will be moved upwardly to actuate the solenoid valve in a direction to move the piston 164 downwardly and bring the roller 82 into contact with the roller 76. This forces the yarn end 32 into engagement with the covering material on roll 76, and as long as the top rollers 82 and 76 remain thus in engagement, dye is applied to the yarn end. Thus, as long as the lever arm 184 is in the upper position engaged by the stud 180, the yarn is printed with the color of the dye of pan 122. However, after the drum 174 has rotated further so that the arm 184 drops off stud 180, then the solenoid valve is actuated in the opposite direction, and the roller 82 is moved back to the upper position shown, in order to release the engagement of the yarn end 32 with the print roller 76.

As viewed, almost immediately thereafter, the next adjacent projecting stud 178 is engaged by the arm 184 and again the roller 82 is moved to the down position to dye the yarn 32 for another portion of its length. Control of the position of upper roller 82 is controlled by the location of the studs on the drum 174, and the dwell of roller 82 in contact with roller 76 will be determined by the peripheral length of the studs. For example, stud 180 is of longer peripheral length than studs 176 and 178. Therefore, a longer length of yarn will be printed.

Figure 9:
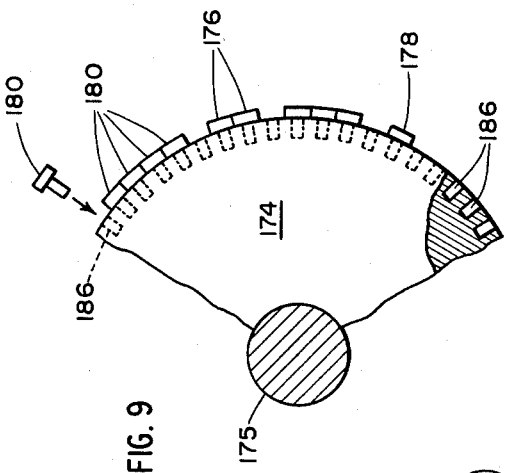
FIG. 9 shows in elevation a portion of a single control drum used in FIG. 8.
Figure 8:
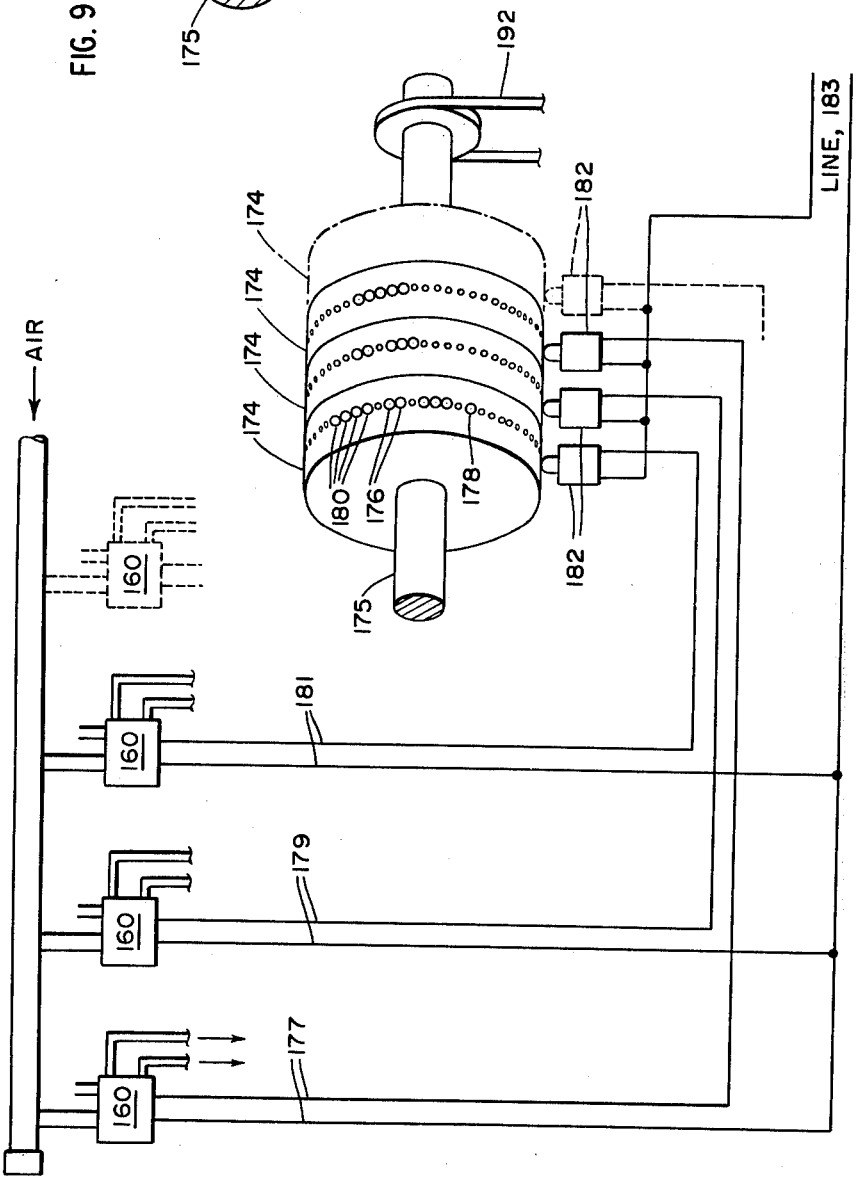
FIG. 8 shows schematically certain details of the control drum apparatus for the printing apparatus of FIG. 5.

Referring now to FIGS. 8 and 9, a schematic diagram of a wiring circuit for control of the printing rolls is shown, and an enlarged view of the circuit control drum.

The valves 160 are shown, each one controlling the motion of a respective upper print roller 78, 80 and 82. (In dotted lines is shown a fourth valve which would control a fourth print roll 86 if used.)

The control drums 174 are mounted in a common drive shaft 175 and are driven thereby. Shaft 175 is driven, as described above, by the outermost finned roll 112. Each drum controls a respective single solenoid valve 160.

Positioned below each drum is mounted a snap switch 182 which is to be actuated by the projecting studs 174, 178, 180 et al. as described above. The electrical circuitry indicated by wires 177, 179 and 181 for the connecting and operation of the valves 160 by a suitable line voltage 183 are shown schematically, and being conventional, are not further described herein, except to note that upon actuation of the drums, the engagement of a given snap switch follower by the studs of its respective drums, will cause only the one respective upper print roller to go through a printing cycle, irrespective of the operation of the other print rollers by their own snap-switches and valves.

Referring to FIG. 9, a portion 174 of a drum is shown. It may be made of metal or suitable synthetic resin, and holes 186 radially extend inwardly from its periphery. The plugs or studs 176, 178, 180 and others as needed, are inserted in the holes. The studs preferably have square heads, the edges of the heads of adjacent plugs touching so that a relatively smooth non-discontinuous surface will be presented for engagement by the feeler arm or actuating button of the respective snap switch. The studs may be made of a resilient synthetic plastic material, or soft rubber, with shanks that fit snugly into the holes 186.

As examples of the air cylinder and solenoid valve which may be used, the cylinder 158 can be a Wabco $3\frac{1}{4}''$ by $3''$ air cylinder, Type No. PC60188-0030, made by WABCO Fluid Power Division, 1953 Mercer Road, Lexington, Kentucky. The check valves 162 and 164 are each made by Skinner Electric Uniflow Valve Division, 95 Edgewood Avenue, New Britain, Conn. and are their flow control valves F131-200. The solenoid valves 160 may be, for example, a Versa Type USG4522 made by Versa Products Company, Inc., 144 Coolidge Avenue, Englewood, N.J.

Other incidentals of the construction shown are that the covering on the roller 76 can be a primary carpet backing such as a non-woven polypropylene, and the roller dips about $\frac{1}{2}''$ in the dye in the dye pan. Doctor roller 152 is approximately $2\frac{1}{2}''$ in diameter, is the full length of the roller 76, and is loaded so as to bear against the latter with a force of about fifty to seventy-five pounds.

Another feature of the invention is that all of the rollers at the output end of the printer to pull the web of yarns therethrough, are finned and the purpose of the finned construction is two-fold: the first is to obtain a much greater control of the yarn ends as they are pulled out of the printing apparatus, and the passing of the yarn ends over the outwardly projecting fins gives this kind of control as compared to what the lack of control due to slippage if no fins were used. In addition, because the dye stuff on the yarns is still wet, it is desired to keep the yarns out of contact with the surface of the output rollers. The fins do this by spacing the yarns from the surface of the rollers. The rollers themselves are approximately 4" in diameter, are made of stainless steel, and each has four fins. The fins extend approximately $1\frac{1}{8}$" from the peripheries of the rollers, are approximately $\frac{1}{8}$" in thickness, extend the full length of each roller, and are made of stainless steel. The fins are fitted into slots in the rollers, and welded therein.

Referring also to FIG. 6, another feature of the invention is shown in that the control drum 174 is driven by the last exit finned roller 112. The purpose of doing this is to maintain accurate control of the particular portion of the lengths of the yarn ends which are being dyed. A chain drive mechanically connects the last finned roller 112 with the input shaft of an electrically actuated brake-clutch mechanism 190. When the device is driven at its input shaft, with the clutch engaged and the brake released, the output shaft will rotate. Normally the clutch is always engaged and the brake disengaged.

The output shaft of mechanism 190 is connected by a chain drive to the control drum 174.

Each of the rollers 110, 112 is driven by a single motor, and each roller is conventionally connected by drive means such as conventional sprocket wheels and chain linkages to each other.

In connection with the correction for wet yarn length growth (or retrogression of yarn through the printing apparatus), in the event the apparatus should be stopped, a brief description will now be given as to the use of the brake-clutch mechanism 190 and its operation.

Assuming for the sake of illustrating the operation, that it is desired to stop the printing apparatus (and also possibly other parts of the total system). In order to utilize most effectively the brake-clutch mechanism 190, it is preferred that in order to obtain an accurate reference point on a single yarn or a reference line extending across the entire web of yarns for corrective adjustment, any stopping of the printing apparatus takes place just as the top print roll 82 is about to lift from the bottom print roll 76. The stopping of the printing mechanism is done, of course, by stopping the motor which drives the finned rollers 110 and 112. In some cases, such stopping for any length of time, will permit the wet yarn to elongate, and thus throw the printed sections (across a web of such yarns) out of their proper longitudinal sequence with respect to the position of the plugs 184 on the control drum. It is necessary to correct for this prior to starting up the printing apparatus again.

The brake-clutch mechanism 190 is a conventional one, and is controlled electrically by means of a manually operated push-button switch (not shown) which is connected to a suitable source of voltage such as 115 to 120 volts AC. Such brake-clutch devices are made by a number of people and are common on the market. Therefore, little description is necessary therefor except to say that when no control voltage is applied to the brake portion of mechanism 190, the clutch is normally in engagement and the brake is disengaged, so that as the roller 112 turns, it is enabled to turn the drum 174 as explained above. On the other hand, if the brake-clutch mechanism 190 is actuated by connecting it to the above voltage source through said manually operated switch, then the clutch becomes disengaged, and the brake is applied. As earlier stated, the mechanism is mechanically connected to the roller 112 and the timer drum 174, so that when the brake is applied, it holds the timer drum 174 motionless. Simultaneously, the clutch is disengaged, with the result that the rollers 110 and 112 can be turned independently of the drum 174.

Assuming that the machine has been stopped, and that longitudinal de-alignment or shift has occurred, the push-button is operated to operate the brake-clutch control 190 to apply its brake and thus hold the drum 174 motionless, and at the same time to disengage the clutch and permit freedom of rotation of the rollers 110 and 112. Then, in order to advance the yarn (which has, for example, elongated due to being wet) to the proper indexing point in the printing apparatus, the motor that runs the rollers 110, 112 is jogged by a manually operated switch (not shown) so that the yarn web is moved through the printing apparatus until the correct positioning of the rear end of a printed section is properly aligned with the selected pair of print rollers. Thereafter, the brake is disengaged so that the timing drum is again driven by the roller 112.

A further important feature of the invention is illustrated in FIG. 6, in that the yarns 32 pass the print rollers 76 and 82 in a slanting direction, the yarn ends passing over an upper guide roller 106 before each set of print rollers, and over a guide roller 108 (or under a guide roller 104) at the down stream side of each set of print rollers. This slanting relationship of the yarn end 32 as it passes between the rolls is a special feature of the invention and its purpose is as follows:

When, for example, an upper roller 82 is moved downwardly against the roll 76, a puddle of dye stuff will form at the entering side of the nip between the two rollers, through which the yarn passes during the printing operation. Assuming, now, that the yarn end instead of passing downwardly at the slant shown in the drawings traverses through the nip of the rollers in a direction perpendicular to a plane containing the axes of the print rollers. It has been found by experience that as the top roller is lifted to stop printing a length of yarn, the puddle of dye stuff (which extends the full length of the rollers), does not leave the yarn ends quickly enough after the rollers part, but instead continues to hang on to the yarn ends. This, of course, leads to inaccuracy of printing of the yarns.

It has been found, and the reason therefore is not clearly known as yet, that if instead of passing the yarn ends through the print rollers in a direction which is perpendicular to the plane which contains the axes of the upper and lower rollers, the yarn ends pass through these rolls at an angle of approximately 60° to 85° to the said plane. When this angle is used, and the rollers separate, it will be found that the yarn ends leave the puddle of dye through which the yarn has been passing ahead of the nip of the rollers almost immediately when the upper roller 82 is moved upwardly and the roller nip opens. The capillary action of the covering on the bottom roller 76 is then enabled to quickly flatten out the dye stuff puddle which remains on the roller 76 instead of adhering to the yarn ends and passing therewith to the next set of printing rollers. As a result, printing accuracy is greatly enhanced by this angular relationship.

Figure 7:
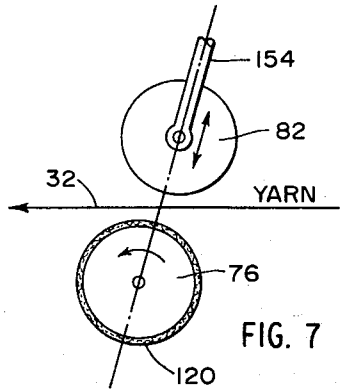
FIG. 7 shows an alternate arrangement of the printing rolls of FIG. 5 which maintain, as well as the arrangement of FIG. 5, certain desired relationships between the path of the yarn through the dyeing apparatus rollers in respect to a plane containing the axes of a pair of cooperative print rollers.

In respect to this angularship, attention is drawn to FIG. 7, and it will be noted that in this instance the yarn 32 is shown passing in a horizontal direction through the printing rollers. However, it will also be noted that the upper roller 82 is now displaced to the right (as drawn in FIG. 7) with respect to the lower roll 76 (that is, is upstream of the flow direction of the yarns), so that again the angle that the yarns 32 make with the common plane containing the roller axes is again 60° to 85°. Again, with this arrangement, it will be observed that the puddle of material adjacent the nip of the rollers, leaves the yarn end quickly when upper roller 82 starts to move upwardly, so that the puddle does not follow the yarn as it progresses through the printing machine, but instead almost immediately flattens out and stays on the surface of the lower print roller 76.

Reference is again made to FIGS. 6 and 7 in which are views in which are respectively shown two positions of common planes of the axes of the print and pressure rollers. In FIG. 6 the plane is vertical, and in FIG. 7 the plane slants. The above has already been described. Yarn 32 is shown entering the rollers from right to left as drawn and indicated by the arrow, In the earlier description, in respect to the angle the yarn makes with the common plane of the roller axes, it is taught that said angle can lie within the range of 60° to 85°, measured clockwise (as viewed) from the upper portion of the plane. However, it is also true that the angle can lie within the range of 30° to 60° as well, although the 60° to 85° is preferred.

If the direction of motion of the axis of the pressure roller is such that when the rollers are separated, the common plane of the roller axes is at an angle to the common plane when the rollers are in engagement, the above criterion still applies, and the angles are to be measured from the common plane established when the rollers are apart.

Referring now to FIGS. 12 and 13, a second embodiment of the invention is shown. In this embodiment, the axes of rollers 76 and 82 lie in a horizontal plane.

Referring specifically to FIG. 13, there are shown schematically the rollers with associated apparatus for their control, as well as schematically represented apparatus for providing ink.

Roller 82 is the pressure roller and is moved horizontally toward and away from print roller 76 by means of air cylinder 158 as in the first embodiment. The supply of air to cylinder 158 is governed by valves 160, 162 and 166 as before, and actuation of the piston rod 156 by the cylinder piston moves roll 82. Suitable ink feed control and delivery apparatus indicated generally by numeral 284 is provided, and may be the same as that shown and described for the first embodiment with suitable changes which will be apparent to one skilled in the art. The rollers, and the feed of the yarn thereto, are all controlled by the timing means set forth above with respect to the first embodiment.

Yarn 32 is shown as entering the rollers from left to right, in the direction indicated by the arrow.

Referring now to FIG. 13, the yarn, or a web thereof, contacts the pressure roller tangentially at a point 296 which is spaced from the common horizontal plane a vertical distance A as shown, (which is referred to in the claims as the first distance). From point 296, during printing, the yarn is engaged by the pressure roller, but upon separation of the rollers 76 and 82, the yarn is free of both.)

A quantity or puddle 298 of printing ink contacts both rollers 76 and 82 when they are in engagement, as shown. The amount of the ink forming the puddle is predetermined so that its contact with the rollers extends outwardly to the points 300, which are at a vertical distance B from said common plane (in the claims this distance being called the second distance), and the yarn first makes contact with the ink at the left-hand point 300 as viewed. Of course, the amount of ink in puddle 298 is maintained by the feed apparatus so as to permit printing the desired length of yarn.

The engagement of the press roller with the covering 120 on roll 76 is such as to compress the covering toward the center of the roll, with the result that an imaginary chord C may be drawn extending between the points 302 where the covering material first engages and then leaves the roller 82. The chord length in the appended claims is called the third distance.

The angular relations between the yarn and the plane containing the roll axes as given above in respect to FIGS. 6 and 7 embodiments, may be used in this embodiment. Another criterion is as follows: As long as distance A is equal to or greater than distance B, and the distance B is minimized or approximately equal to distance C, problems in regard to excessive dye ink on the yarns will be minimized, if not completely avoided.

IV DYE SETTING APPARATUS

The function of putting the yarns through the steam chamber 8 is to fix the dye on or within the fibers of the yarn end. In the steam chamber, the yarn is passed therethrough by the conveyor belt in a completely relaxed state. Live steam passes upwardly through the belt and through the yarn while heat is radiated downward on the yarn from the chamber roof.

Referring to FIG. 1 of the drawings, the dye fixation apparatus consists of an elongated chamber adapted to receive the upper reach of the conveyor belt 116, the chamber having an entrance roll 194 and exit roll 196 over which the conveyor belt is trained. Suitable rollers may be used, if desired, on the underside of the box to support bottom reach of the conveyor belt. The conveyor belt itself is of open mesh construction to permit air or stream to pass easily through it, and on the inside of the chamber slides along a support which is preferably perforated for transmission therethrough of steam. Steam pipes lead into the box itself, beneath said support, and thus beneath the upper level or reach of the belt and is thus enabled to pass upwardly through the yarn on the belt. Means are provided for heating the roof of the chamber, which prevents steam condensation and makes possible temperatures in the chamber of the order of 210° to 230° F. Air locks 198 are provided at each end of the steam chamber (a portion only thereof being indicated at the left-hand end as drawn of FIGS. 1 and 2), these locks being fitted with suitable exhaust means that are used to purge air from the steam chamber, carry off excess steam from the latter, and cool the yarn before it exists from the chamber. In the chamber, steam passes upward through the belt and through the yarn while heat is radiated down the yarn from the chamber roof. Fixation of the dye stuff onto the fiber is brought about by a yarn dwell time of 1 to 5 minutes in the steam chamber at said temperatures.

After belt 116 exits from the chamber, it passes through the nip of two rolls, one of these being the exit roll 196 on which the conveyor belt is trained, and the other being a top nip roll 200. It is important to note that the tensionless yarn on the belt is not withdrawn from the latter until the yarn has passed through the nip of rolls 196 and 200. In this manner, it will be found that the individual yarn ends will be withdrawn from the conveyor belt without entanglement. From the belt, the yarn ends pass over curved slide member 202 which because of its curvature will tend to restrain the yarn and keep it in alignment, and then the yarn ends pass around a floating tensioning roller 204 which is enabled to move horizontally, and which exerts a constant tension on the yarn and tends to equalize any unevenness in yarn length up to this point. The roller 204 may be actuated by suitable weights, similarly to the roll 46 of the testing device, or can be actuated by other means. Switches, not shown, operated by roller 204 operate the drive motors for the succeeding steps.

V WASHING APPARATUS

Figure 10:
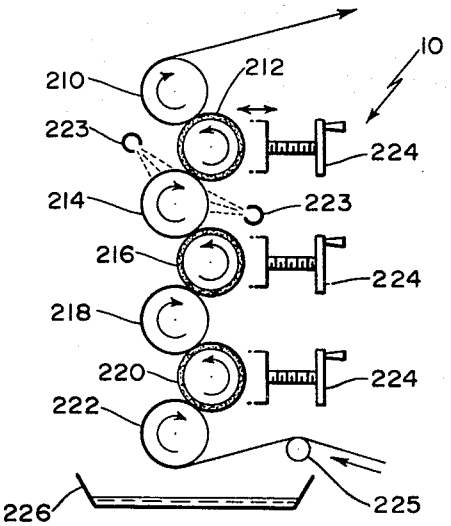
FIGS. 10 and 11 show schematically elevations of two embodiments of a washing machine for the yarns after the yarn has been dyed, the dye stuff has been set in the yarns but prior to drying of the yarn.
Figure 11:
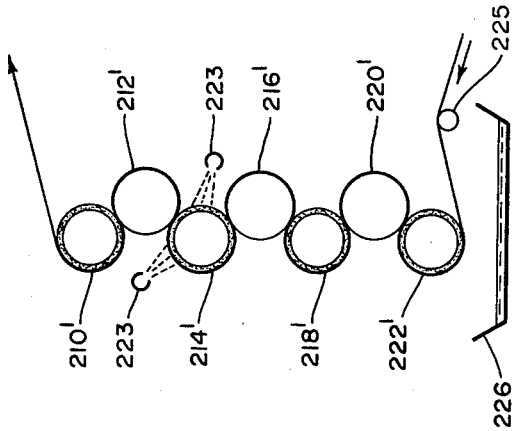

From the steam chamber as indicated above, the yarn is pulled off the conveyor belt 116 and then passes to a washing unit which is indicated generally by numeral 10 in FIGS. 1 and 2, two embodiments of which are schematically shown in greater detail in FIGS. 10 and 11. Referring first to FIG. 10, the embodiment comprises a plurality of rollers 210, 212, 214, 216, 218, 220 and 222. Rollers 210, 214, 218 and 222 are of stainless steel with smooth surfaces. These rollers are long enough to accommodate the entire sheet of yarn ends. The rollers 212, 216, and 220 are of stainless steel and are covered with the same kind of covering material used to cover the bottom print rollers 72, 74, 76 and 78, and can be several turns of a non-woven polyproplene carpet backing material. The rollers 212, 216 and 220 are movable horizontally by manually operable controls illustrated schematically by numeral 224 so that the bite or nip between the rollers 212, 216 and 220 and their adjacent rollers 210, 214, 218 and 222 may be adjusted for the particular yarns being washed. Each of the rollers is driven by conventional means (not shown). Water is fed by means of manifolds 223 onto roller 214 at the nip between it and roller 212. Thus, the rinse water for the washing apparatus feeds by gravity downwardly, with the result that the cleanest water (incoming) is applied to yarn material which has progressed upwardly through the apparatus and has been previously washed lower in the ladder of wash rollers.

A drain pan 226 is used to collect and carry off the drain water. It will also be noted that the yarn travels in a serpentine path around the rollers in such direction that the yarn encircles a major portion of the periphery of each roller as it moves upwardly. A guide 223 may be used if desired.

The material which covers the rollers 212, 216 and 220 has a capillary action which assists in withdrawing moisture from the yarn, and particularly in respect to roller 212 which is the uppermost roller. It will be noted that the direction of rotation of the rollers is such that the yarn passes through the nip between rollers 210 and 212 after the introduction of rinse water from the infeed manifolds 223. As a result, the capillary action of the covering material acting on the final passage of the yarn through the last nip, assures a low and uniform moisture content in the yarn.

The yarn enters the roll stack at the bottom and follows a serpentine path around the rollers to the top. The cascading water and the squeezing action of the rollers effectively wash out any unfixed dye material from the yarn. The quantity of water needed with this method is greatly reduced since the water is used several times during its passage down the rollers. Also, each covered roller is squeezed at two opposite sides rather than one as is normally the case for the series of two roller wringers. This doubles the number of wrings for any given number of wrapped rollers, or half the number of wringings.

Referring now to FIG. 11, it has been pointed out with respect to FIG. 10 that rollers 212, 216 and 220 are covered with water absorbing material. However, rollers 210, 214, 218 and 220 could be covered, and rollers 212, 216 and 220 be bare. This arrangement is shown in FIG. 11, in which rollers 210', 214', 218', and 222' are covered and rollers 212', 216' and 220' are bare. As in FIG. 10, the water supply manifolds are provided, as well as drain pan 226. As in the FIG. 10 embodiment, the yarn travels in a serpentine path around the rollers in such a direction that the yarn encircles a major portion of the periphery of each roller as it moves upwardly. The roller adjustment means of FIG. 10 is to be used, but has been omitted from FIG. 11 for purposes of clarity. A guide 223 may be used, if desired.

VI DRYING AND HEAT SETTING APPARATUS

From the washing mechanism 10, the yarn is pulled by means of the finned drive rollers 230 into the drying chamber 12. Chamber 12 is shown schematically and comprises an elongated chamber having four hot air inlets at 13, 15, 17 and 19 leading into the chamber at the top so that the chamber basically is divided into four zones through which air passes downwardly and through the yarn. The yarn ends are then led to a set of finned rollers 230, and from the latter the yarn is deposited on a chute 232 made of stainless steel. Chute 232, like chute 114, restrains the yarn ends as they come from the finned rollers so that the yarn ends fall by gravitational force gently in overlapping plaits on the end of an open mesh conveyor belt 234. The conveyor belt is trained on entrance rollers 236 and exit rollers 238. Because of the open mesh of the belt, air can pass freely through it and yarn deposited thereon. The chamber has conventional means (not shown) for removing air from under the top reach of the belt, exhausting part of this air, adding fresh replacement air, heating the incoming air, and forcing the latter from above the upper reach of the belt and downwardly through the upper reach of the belt. The yarn, as described above, is in plaits in a relaxed state on the belt, and passes through the hot air chamber in this condition so that the exposure of the yarn to the hot air moving through it makes for fast efficient drying and stress relieving. At the exit end of the chamber, there is provided the nip roller 240 and just as has been described above for the exit rollers from the steam chamber, the yarn is not withdrawn from conveyor belt 234 until the yarn plaits have passed between the nip of rollers 238 and 240.

Configuration of the drying chamber is such that after the yarn is dried, its temperature may be effectively and uniformly raised to the heat setting temperature for the thermoplastic yarn. It is thus possible to stress relieve or heat set a thermoplastic yarn in the same hot air chamber. It has been found that in order to do this, and assuming that functionally the chamber is divided along its length into four zones, the temperature of drying can be applied during the first three zones moving from left to right as drawn in FIGS. 1 and 2, and then in the last zone which would be approximately $\frac{1}{4}$ of the length of the chamber, the temperature of the dry yarn is raised to such point that the yarn itself will reach the setting temperature.

VII YARN LATERAL DISPLACEMENT APPARATUS

As the yarn emerges from the nip rolls 240, 238, it is drawn up over a curved slide 244 and between the brake bars 246 to restrain but not stop the movement of the drived and/or heat set yarn from the belt. Each end of yarn is then passed through a guide bar or reed 248 through which each yarn end passes separately. By means of the reed, any lateral dealignment which may have taken place thus far in the yarns is restored so that each yarn is in the same lateral position, with respect to other yarns, as they were when they emerged from the printing apparatus 6. Thereafter, each yarn end is passed through shuffling plates as described in U.S. Pat. Nos. 3,447,215 and 3,621,780 to shift and laterally rearrange the position of all yarns with respect to each other. Each yarn is moved so that it occupies the maximum mathematical position away from the printed lateral position that it can occupy. This eliminates any side to side color variations which can be present in the printed web of yarn.

VIII YARN ACCUMULATOR APPARATUS

Following the emergence of yarn ends from the shuffling (or lateral displacement) mechanism 14, the yarn ends then pass around the roller 256 and the floating roller 258. At this point, the yarn ends can take two further steps or treatments. In FIG. 1, the yarn ends will be fed directly through an accumulator and a longitudinal de-aligner and finally directly to a tufting machine. In FIG. 2, the yarn ends will be lead through a longitudinal de-aligner which includes a longitudinal aligner, and then to warp beams or other suitable storage means such as cones, where the ends are wound.

Referring first to FIG. 1, the accumulator is indicated schematically by numeral 16, and comprises the fixed top rollers 260 and the floating bottom rollers 262. Not all of the bottom rollers 262 need be made floating, and within the skill of the art this determination can be made without any inventive characteristics. The dancer roller 258 may be constructed to move vertically or horizontally, and its motion can be used to control the feed of yarn into the accumulator.

IX YARN LONGITUDINAL ALIGNMENT AND/OR DEALIGNMENT APPARTUS

From the bottom roller 264, the yarn passes through suitably positioned rollers into the longitudinal aligning and/or de-aligning apparatus indicated generally by numeral 18. The teaching of this apparatus will be found in U.S. Pat. Nos. 3,447,215 and 3,621,780 identified above, and that teaching is incorporated herein by reference.

Summarizing that teaching, each end of yarn after it emerges from the accumulator passes through a separate movable guide. Each guide can be moved so that the longitudinal relation of each yarn to all of the yarns can be changed. Differences in the lengths of the paths of different ends of yarn causes them to be displaced from the longitudinal alignment existing when the yarns were printed. By suitable adjustments of the above movable guides or rollers, any longitudinal de-alignment of the printing alignment that has occurred in processing up to this point can be restored to the extent desired.

The yarn passes around two or more guides or rollers which are arranged so that the lengths that the yarn travels around them are different. By selecting which of the rollers of apparatus 18 each end of yarn goes around, the longitudinal relation of all of the yarns can be set in predetermined fashion. In this way, both realignment and/or de-alignment of any yarn with respect to other yarns in the sheet or web may be effectuated, and as a result a variety of desirable patterns can be introduced into the final carpet.

X CARPET INSPECTION APPARATUS

Still referring to FIG. 1, after leaving the longitudinal de-alignment or realignment mechanism 18, the yarns then pass directly to a tufting machine indicated generally by numeral 20. Since such machines are conventional, no further description will be given here. From the tufting machine, it will be noted that as usual the fabric emerges with its pile surface downward. It is desirable to be able to see that surface for inspection before the fabric is wound up on its storage roll. In order to do this, the fabric must be inverted so that the pile surface is uppermost. To do this, the fabric with its pile surface downwardly is led in a first direction away from the tufting machine to a point remote therefrom. Its direction is then reversed by training it around a roller and it is led in a second direction toward the tufting machine to the point where it is wound on storage rolls. During its passage in the second direction, its pile surface will be uppermost, and it can be conveniently inspected. Accordingly, one apparatus for doing this is shown in FIG. 1.

Referring thereto, the fabric 266 passes from the tufting machine beneath a platform 268, and is trained around an end roller 270, and then traverses the top of the platform in the reverse direction. As it so traverses, the pile surface is uppermost, and an inspector standing on a platform 272 can inspect the material and its pattern. At the right-hand end of the platform is mounted a suitable roller so that the carpet moves upwardly where any gaps in it may be hand tufted if desired.

As the carpet continues, it is supported by supporting rollers 274 and then passes down to the wrap up station 276. Suitable lights 278 are provided to illuminate the carpet when being inspected.

Referring to FIG. 2 for a second embodiment, the yarn as it emerges from the lateral shuffling mechanism 14, instead of going through an accumulator 16, passes over the floating dancer roller 258 and then over suitable top guide rollers 280 and to the longitudinal aligning and/or de-aligning apparatus 18, which is the same as is described above. The yarn emerges from the apparatus 18, and passes over suitable rollers to the warp beams 282 on which the yarn is wound. Thereafter, at the desire of the carpet tufter, suitable warp beams can be moved into positions before a tufting machine, and tufting is then performed; or yarn can be transferred from the beams to cones and then tufted from the cones. After tufting, the above carpet inspection apparatus may be used.

In view of the above, it will be seen that the several objects of the invention are achieved, and other advantageous results attained.

It is to be understood that the invention is not limited in its application to the details of construction and arrangement of parts illustrated in the accompanying drawings, nor to the methods described, since the invention is capable of other embodiments and of being practiced or carried out in various ways. Also, it is to be understood that the phraseology or terminology employed herein is for the purpose of description and not of limitation.

As many changes could be made in the above constructions and methods without departing from the scope of the invention, it is intended that all matter contained in the above description or shown in the accompanying drawings, shall be interpreted as illustrative and not in a limiting sense, and it is also intended that the appended claims shall cover all such equivalent variations as come within the true spirit and scope of the invention.

I claim:

1. Apparatus for treating yarn ends comprising:

means conveying the yarn ends from a source thereof to a first roller positioned to lead the yarn ends from the source, the yarn ends being trained on the roller and the roller letting the yarn ends fall downwardly by gravity upon exit therefrom;

first restraining means positioned below the first roller to receive the yarn ends and restrain their motion as they fall downwardly;

a steam chamber for treating the yarn ends and having entrance and exit ends;

a first conveyor belt passing through said entrance end into the steam chamber and therefrom through its exit end, said conveyor belt being positioned to receive the yarn ends in overlapping plaits thereon as the yarn ends leave the first restraining means;

first nip rolls at the exit end of the steam chamber through which the conveyor belt passes, and being positioned so that the plaits of yarn pass through the nip of said rolls before leaving said conveyor belt;

means for removing the yarn ends under tension from the first nip rolls, removing the yarn ends from the belt substantially as soon as the plaits pass through said nip and equalizing their lengths;

yarn washing apparatus adjacent said nip rolls;

yarn drying apparatus adjacent said washing apparatus;

a second roller positioned to receive the yarn ends from the washing apparatus, the yarn ends being trained on the second roller and the second roller letting the yarn ends fall downwardly by gravity upon exit and therefrom;

second restraining means positioned below the second roller to receive the yarn ends and restrain their motion as they fall downwardly;

a drying chamber for drying the yarn ends and having entrance and exit ends;

a second conveyor belt passing through said lastmentioned entrance end into the drying chamber and therefrom through its exit end, the second conveyor belt being positioned to receive the yarn ends in overlapping plaits thereon as the yarn ends leave the second restraining means;

second nip rolls at the exit end of the drying chamber through which the second conveyor belt passes, and beings positioned so that the plaits of yarn pass through the nip of said rolls before leaving the second conveyor belt; and means for removing the yarn ends under tension from the second nip rolls, removing the yarn ends from the belt substantially as soon as the plaits pass through said nip and equalizing their lengths.

2. The apparatus of claim 1 in which the second restraining means comprises a chute inclined at an angle to the vertical and having upper and lower ends, the upper end of the chute being positioned to receive said yarn ends from said second roller, and its lower end being positioned above the entrance end of the second conveyor belt.

3. Apparatus for treating yarn ends comprising:

printing means for printing the yarn ends with dye-stuff at predetermined intervals and for predetermined sectional lengths thereof;

timing means for controlling the printing means;

at least one first roller positioned to lead the yarn ends from the printing means, the timing means being energized by said first roller, said first roller letting the yarn ends fall downwardly by gravity upon exit therefrom;

control means operatively connected between said first roller and the timing means and having first and second operating conditions, said control means when in the first condition thereof permitting operation of the timing means by the first roller, and when in the second condition thereof disengaging the timing means from said first roller while simultaneously applying a brake to the timing means to hold the latter immobile during the time said control means is in its second condition;

first restraining means positioned below the first roller to receive the yarn ends and apply a torsional restraint to the yarn ends as they move downwardly;

a steam chamber for fixing the dye-stuff on the yarn ends and having entrance and exit ends;

a first conveyor belt passing through said entrance end into the steam chamber and therefrom through its exit end, said conveyor belt being positioned to receive the yarn ends in overlapping plaits thereon as the yarn ends leave the first restraining means;

first nip rolls at the exit end of the steam chamber through which the conveyor belt passes, and being positioned so that the plaits of yarn pass through the nip of said rolls before leaving said conveyor belt;

means for removing the yarn ends under tension from the first nip rolls, removing the yarn ends from the belt substantially as soon as the plaits pass through said nip and equalize their lengths;

vertical cascade washing means adjacent said first nip rolls including a second roller for pulling the yarn ends under tension from said first nip rolls;

a third roller pulling the yarn ends from the cascade washing means, and thereafter, letting the yarn ends fall downwardly by gravity;

second restraining means positioned below the third roller and positioned to receive the yarn ends and apply a torsional restraint to the yarn ends as they move downwardly;

a drying chamber for drying the yarn ends and having entrance nd exit ends;

a second conveyor belt passing through said lastmentioned entrance end into the drying chamber and therefrom through its exit end, the second conveyor belt being positioned to receive the yarn ends in overlapping plaits thereon as the yarn ends leave the second restraining means;

second nip rolls at the exit end of the drying chamber through which the second conveyor belt passes, and being positioned so that the plaits of yarn pass through the nip of said rolls before leaving the second conveyor belt; and means for removing the yarn ends under tension from the second nip rolls, removing the yarn ends from the belt substantially as soon as the plaits pass through said nip and equalizing their lengths.

4. Apparatus for treating yarns ends comprising:

means for conveying the yarn ends from a source thereof to a first roller positioned to lead the yarn ends from the source, the yarn ends being trained on the roller and the roller letting the yarn ends fall downwardly by gravity upon exit therefrom;

a steam chamber for treating the yarn ends and having entrance and exit ends;

a first conveyor belt passing through said entrance end into the steam chamber and therefrom through its exit end, said conveyor belt being positioned to receive the yarn ends in overlapping plaits thereon as the yarn ends fall from said first roller;

first nip rolls at the exit end of the steam chamber through which the conveyor belt passes, and being positioned so that the plaits of yarn pass through the nip of said rolls before leaving said conveyor belt;

means for removing the yarn ends under tension from the first nip rolls, removing the yarn ends from the belt substantially as soon as the plaits pass through said nip and equalizing their lengths;

yarn washing apparatus adjacent said nip rolls;

yarn drying apparatus adjacent said washing apparatus;

a second roller positioned to receive the yarn ends from the washing apparatus, the yarn ends being trained on the second roller and the second roller letting the yarn ends fall downwardly by gravity upon exit therefrom;

a drying chamber for drying the yarn ends and having entrance and exit ends;

a second conveyor belt passing through said last-mentioned entrance end into the drying chamber and therefrom through its exit end, the second conveyor belt being positioned to receive the yarn ends in overlapping plaits thereon as the yarn ends fall from said second roller;

second nip rolls at the exit end of the drying chamber through which the second conveyor belt passes, and being positioned so that the plaits of yarn pass through the nip of said rolls before leaving the second conveyor belt; and means for removing the yarn ends under tension from the second nip rolls, removing the yarn ends from the belt substantially as soon as the plaits pass through said nip and equalizing their lengths.

* * * * *